US005915391A

United States Patent [19]

Revil

[11] Patent Number: 5,915,391

[45] Date of Patent: Jun. 29, 1999

[54] ELECTRIC COMB HAVING OSCILLATORY MOVEMENT

[76] Inventor: Claude Revil, 48 Rue Pasteur, 87300, Saint Raphael, France

[21] Appl. No.: 08/930,262

[22] PCT Filed: Mar. 19, 1996

[86] PCT No.: PCT/FR96/00410

§ 371 Date: Dec. 30, 1997

§ 102(e) Date: Dec. 30, 1997

[87] PCT Pub. No.: WO96/28990

PCT Pub. Date: Sep. 26, 1996

[30] Foreign Application Priority Data

Mar. 23, 1995 [FR] France ..... 95/03647
Dec. 21, 1995 [FR] France ..... 95/15682

[51] Int. Cl.[6] ..... A45D 24/00

[52] U.S. Cl. ..... 132/119.1; 132/143

[58] Field of Search ..... 132/119.1, 112, 132/113, 114, 124, 143, 144, 150, 152, 155, 120, 108, 129, 136, 142, 271, 219, 212; 15/22.1, 22.2

[56] References Cited

U.S. PATENT DOCUMENTS

| | | | |
|---|---|---|---|
| 3,384,096 | 5/1968 | Paccione | 132/119.1 |
| 3,850,181 | 11/1974 | Baker | 132/119.1 |
| 3,897,794 | 8/1975 | Branch . | |
| 4,958,647 | 9/1990 | Busch et al. | 132/119.1 |
| 5,078,157 | 1/1992 | Golan et al. | 132/119.1 |

FOREIGN PATENT DOCUMENTS

| | | | |
|---|---|---|---|
| A 0 460 610 A1 | 12/1991 | European Pat. Off. . | |
| 670160 | 1/1939 | Germany | 132/119.1 |
| C 670160 | 1/1939 | Germany . | |
| 94 09 578 U | 9/1994 | Germany . | |

*Primary Examiner*—Gene Mancene
*Assistant Examiner*—Philogene Pedro
*Attorney, Agent, or Firm*—Wolf, Greenfield & Sacks, P.C.

[57] ABSTRACT

An electric comb, particularly for combing out and styling difficult hair, comprises a plurality of teeth which are individually mounted and guided to make oscillatory movements. The comb is constituted by a handle (10), a casing (20) containing the tooth drive mechanism, a series of teeth (22) and an electric motor (12). The tooth drive mechanism is a shaft (16) which is rotated by motor (12), comprising eccentric elements (18) forming a camshaft. A second portion of each tooth comprises means for guiding the tooth by eccentric elements of the drive mechanism, which are formed, for example, by a fork with two prongs.

36 Claims, 5 Drawing Sheets

ELECTRIC COMB HAVING OSCILLATORY MOVEMENT

BACKGROUND

The present invention concerns an electrical appliance which can comb out, comb, and style hair, more particularly frizzy or delicate hair.

Existing electrical appliances are intended to stimulate the scalp by massaging it with slow oscillatory movements. A single or multiple comb is driven in slow oscillatory motion by an electric motor. The comb is not used to style the hair but as a means for getting through the hair and reaching the scalp to massage it. For the massage to be effective, it is assumed that the hair is neither dense nor delicate, since otherwise the hair would be pulled out, broken or tangled.

The problem with combing out a frizzy or tangled hairstyle is more complex than massaging, as each little tangled tuft must be treated separately from the neighboring knot. If a conventional comb is oscillated using an electric motor, as described for example in United States patents U.S. Pat. No. 3,384,096 and U.S. Pat. No. 3,870,056, the result is disastrous for frizzy or fragile hair, since a repetitive force is applied to the first tuft encountered by the comb, resulting in its hairs being torn out or broken. Frizzy hair, because of its oval and curled shape, and a low ultimate tensile stress of 40 to 60 grams (g), suffers a great deal of injury during normal hair styling.

SUMMARY

The main object of the present invention is to propose an electric comb which is specially adapted for combing out and styling delicate or difficult hair. This problem has been overcome by considering that each tuft must be treated differently to the neighboring tuft. To accomplish this, the movements made by a person's fingers when attempting to comb out hair should be reproduced with an electric comb: the fingers do not move parallel to one another but move backwards or forwards with respect to one another.

In order for this to succeed, the comb can no longer be a compact body with teeth moving in the same manner, but each tooth must be provided with motion that is different from or offset from the neighboring tooth. To this end, each tooth in the appliance of the present invention is individually mounted on a drive mechanism which guides it in motion which is offset from the neighboring tooth.

In its main embodiment, the electric comb of the present application is constituted by a handle, an electric motor powered by the mains or by batteries, a casing containing a tooth drive mechanism, and a series of teeth. Each tooth is constituted by a first portion which is outside the casing which comes into contact with the hair, and by a second portion which is inside the casing and is in permanent contact with the drive mechanism.

The tooth drive mechanism is a rotary mechanism including eccentric elements. In its main embodiment, the drive mechanism or "camshaft" is a shaft which is rotated by the motor, and which includes disks or "cams" which are fixed eccentrically on the shaft. The cams are disks of circular, elliptical, or oval cross section.

The second portion of each tooth comprises means for coupling the tooth with the eccentric elements of the drive mechanism. In the preferred embodiment of the present invention, the second portion of each tooth has a shape which approximates a fork with two straight prongs, which receive a cam between them. The two prongs of the fork may be parallel but they may also be at a certain angle so as to be capable of confining a cam between them, which cam guides the fork by its rotation.

A second shaft, or "fixed" shaft, passes through each tooth perpendicular to its length. Rotation of the first shaft causes the cam to rotate eccentrically. This motion is transmitted to the tooth by means of the fork, and the tooth will oscillate about the fixed shaft. As a result, the outer portion of the tooth which is in contact with the hair will oscillate in a regular and uniform fashion. If the cams are elliptical or oval in shape, the distance between the two prongs of the fork must be not less than the major axis of the ellipse or oval.

When the shaft of the camshaft is rotated by the motor, all the teeth pivot or oscillate with respect to the fixed common shaft. The end of each tooth will oscillate and describe an arc of a circle. If the cams are offset with respect to one another, the movement of each tooth will be offset from that of the two teeth adjacent to it. If the offset between two neighboring cams is 180 degrees, the teeth will oscillate in phase opposition.

In the preferred embodiment, the cams are offset by an angle which lies in the range 15 degrees to 120 degrees, preferably 90 degrees.

In order to make the second portion of the tooth more compact and more rigid, the two prongs can be replaced by an oblong opening or "aperture" which confines the cam between its two parallel sides.

Using an aperture in place of a two-prong fork means that other variations of the first embodiment of the present invention can be made. In a first variation, the camshaft is between the fixed shaft and the outer portion of the comb. This arrangement has certain advantages over the preceding arrangement, in particular regarding the amplitude of tooth movement. It also allows camtooth contact friction to be reduced, leading to longer service life for the comb and reduced wear.

The external portion of each tooth can be of any shape which is suitable for styling and combing out particular types of hair. As an example, it can be single, double, or multiple, with or without rounded tips, round or elliptical in cross section, flexible or rigid.

In a further variation, the appliance includes teeth on either side of the drive mechanism, for example with one side having single teeth for combing out, and with the other side with multiple teeth or teeth which are closer together for styling the hair.

Still in the first embodiment, it should also be noted that the set of teeth and the fixed shaft can be rendered partially or completely removable, by dint of a device with two clips at the two ends of the fixed shaft, which fix to the casing of the device. In this case, the set of teeth can easily be replaced by another if the user judges that this other set will be more effective. Similarly, the camshaft can be rendered removable by means of a clip system, so that it can be replaced by another, to enable the offset between the cams to be changed.

In a further embodiment, the tooth drive mechanism is a crankshaft which is rotated by the motor and which includes cranks that are eccentric relative to the shaft. Each tooth is guided by one crank of the crankshaft by means of a fork or an oblong aperture, as already described for the first embodiment. A fixed shaft passes through each tooth, and each tooth can pivot about the fixed shaft. The revolving crank also guides each tooth in an oscillatory motion.

In both embodiments presented here, the two-pronged fork or the oblong aperture which encloses a cam or crank can be replaced by a circular aperture with a diameter which is substantially equal to the diameter of the cam or of the crank. In this case, each tooth must have an oblong aperture through which the fixed shaft passes, which provides the tooth with the degree of freedom necessary to enable it to be guided by the eccentric element.

In a third embodiment, the tooth is guided in oscillatory motion by a combination of springs and straight teeth: all of the teeth are straight and located to one side with respect to the camshaft and can oscillate about a fixed shaft. Rotating the cam causes displacement of the tooth from its initial position and a spring connecting the second portion of the tooth to a fixed part of the appliance, for example a wall, causes the tooth to return to the closest position. Return or permanent contact of the tooth with the camshaft can be ensured by any means for bringing about return to an initial position, such as a compression spring, a leaf spring, a pair of magnets of opposite polarity, or a pair of magnets of the same polarity.

Still within the ambit of the invention, the fixed shaft passing through all of the teeth can be replaced by cylindrical walls which confine a central portion of each tooth, while leaving it free to move in rotary manner. The fixed shaft passing through each tooth can also be replaced by centering studs, namely aligned protuberances and cavities. A protuberance engages in the cavity of the following tooth, leaving each tooth free to pivot.

In a preferred embodiment of the present invention, the motor is contained in the handle of the appliance and the shaft of the camshaft or any other means for causing eccentric motion is in the extension of the motor shaft. The teeth are perpendicular to the handle.

However, a comb can be envisaged wherein the handle is perpendicular to the camshaft, i.e., parallel to the teeth. In this case, the motion is transmitted from the motor shaft to the camshaft via bevel gears, worms or any other means for transmitting a rotary motion from one shaft to another which is perpendicular to the first.

The motor used is an AC motor powered by the mains or a DC motor powered by normal or rechargeable batteries. The motor does not need to be incorporated in the appliance but can be external thereto. In this case, the rotary motion is transmitted from the external motor by a transmission cable. Clearly, this appliance can be provided with any other known means for assisting hair styling, examples being hot or cold air blowers.

The aims and characteristics of the present invention will become more clear from the following description. This description, which is in no way limiting, is made with reference to the accompanying figures, in which:

BRIEF DESCRIPTION

Figure 3A:
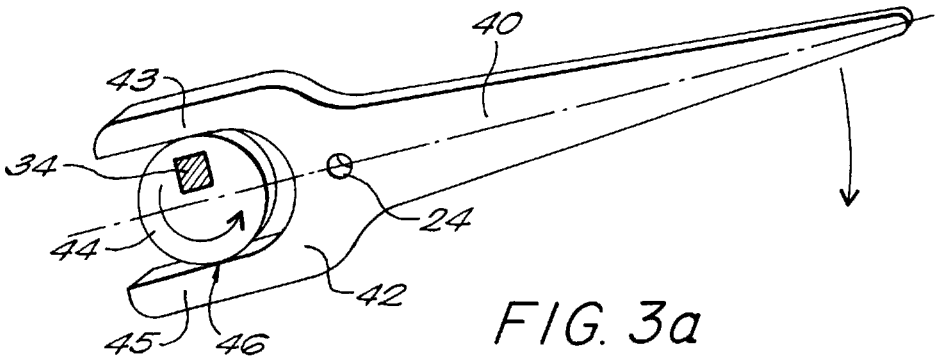
Figure 3B:
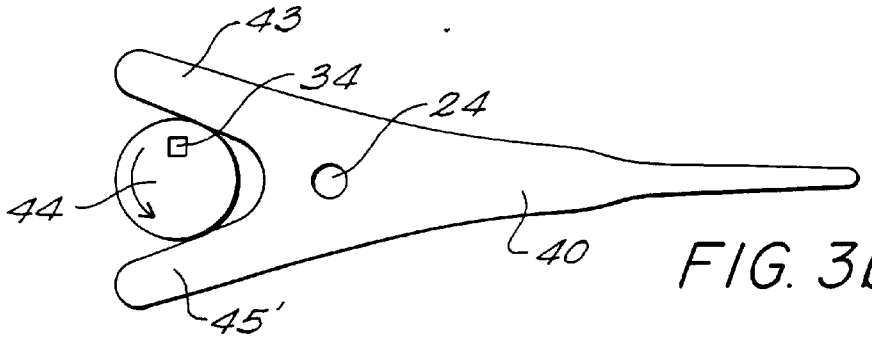
Figure 3C:
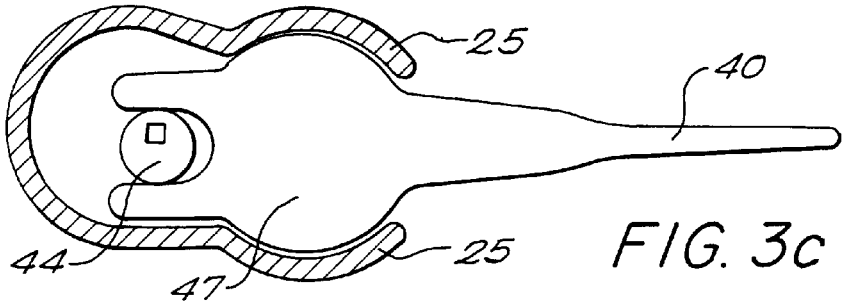
Figure 3D:
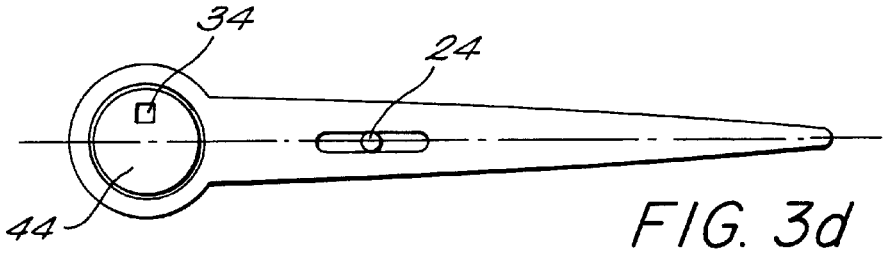
Figure 4:
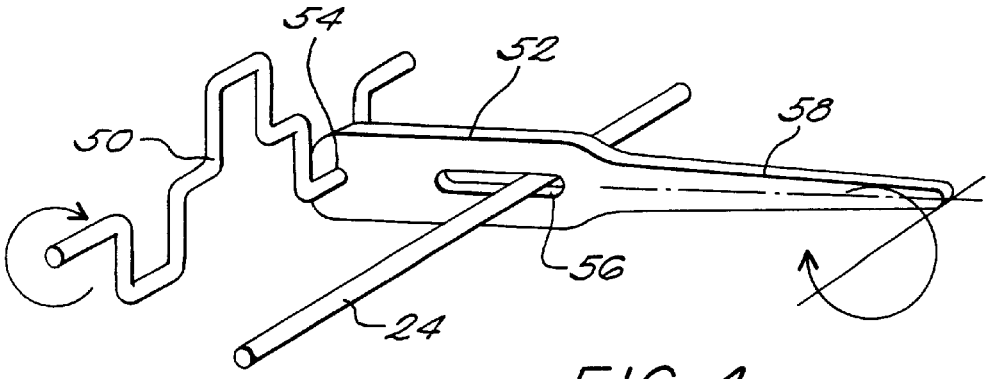
Figure 5A:
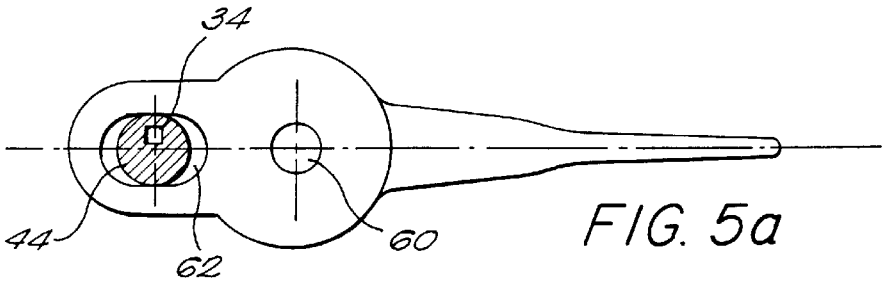
Figure 5B:
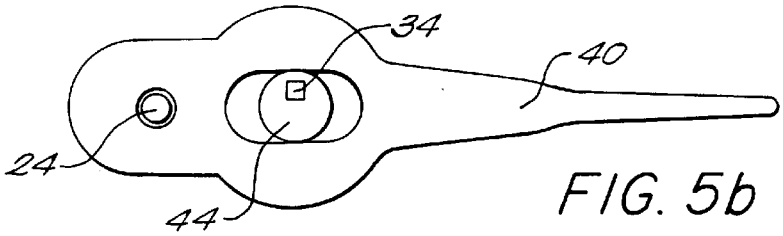
Figure 6:
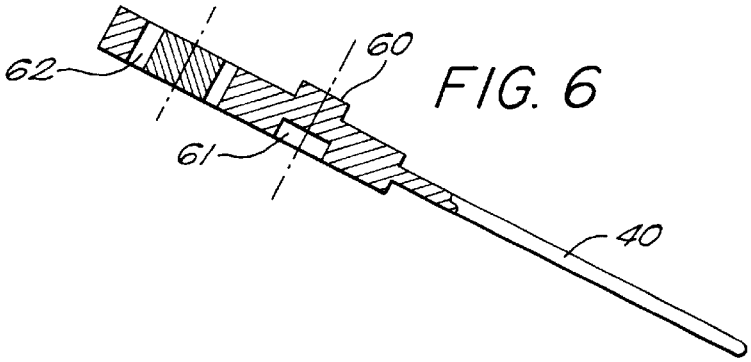
Figure 7A:
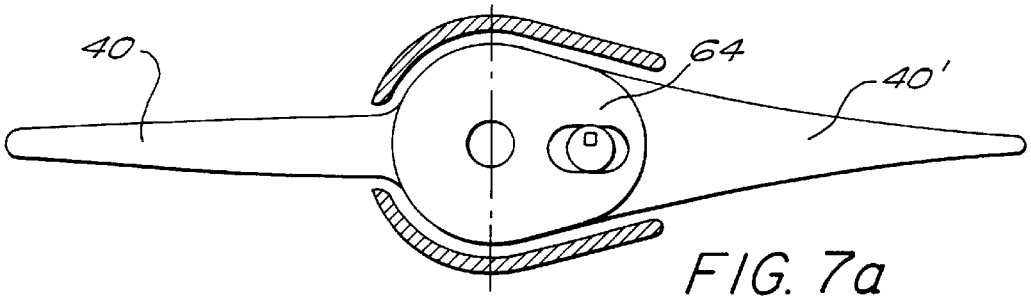
Figure 7B:
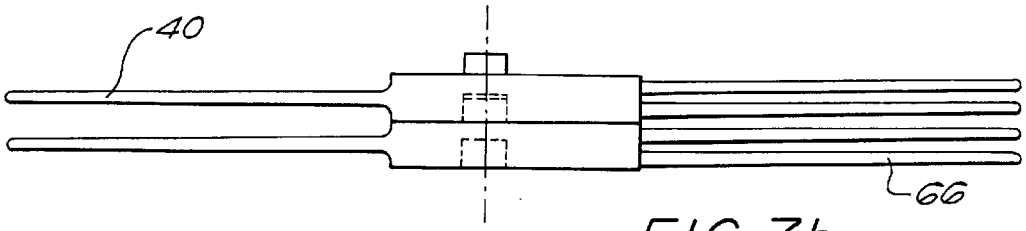
Figure 8A:
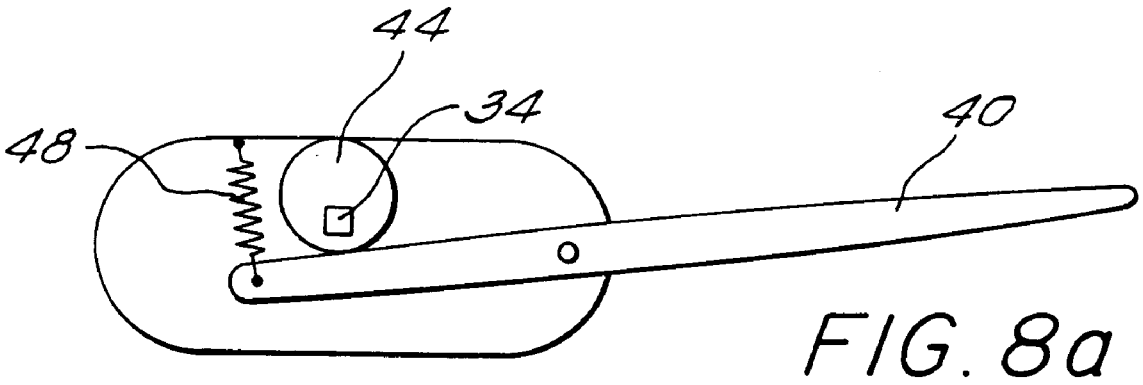
Figure 8B:
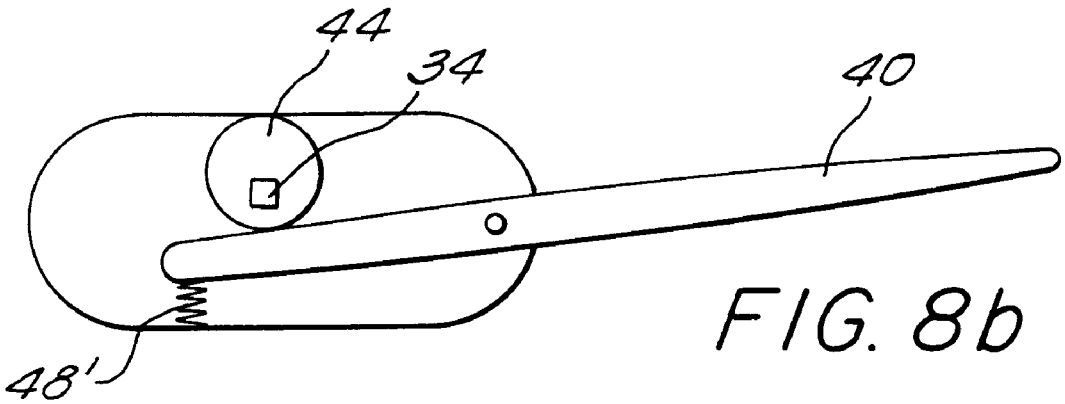
Figure 8C:
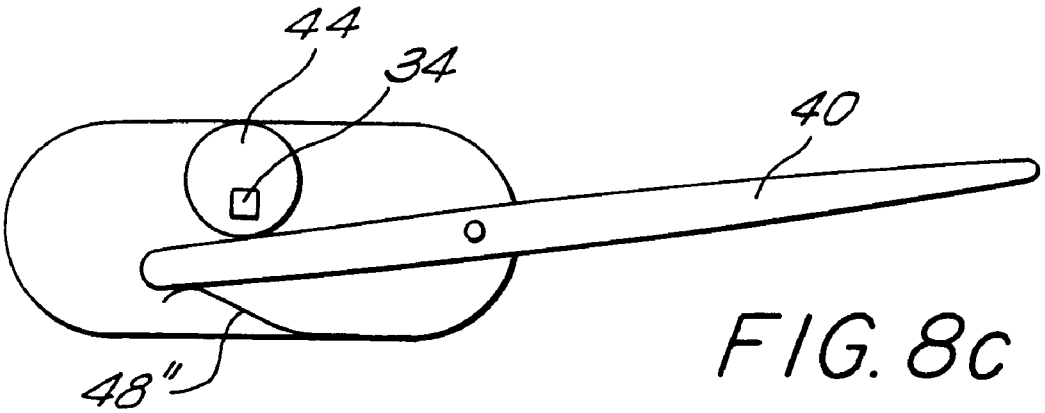
Figure 8D:
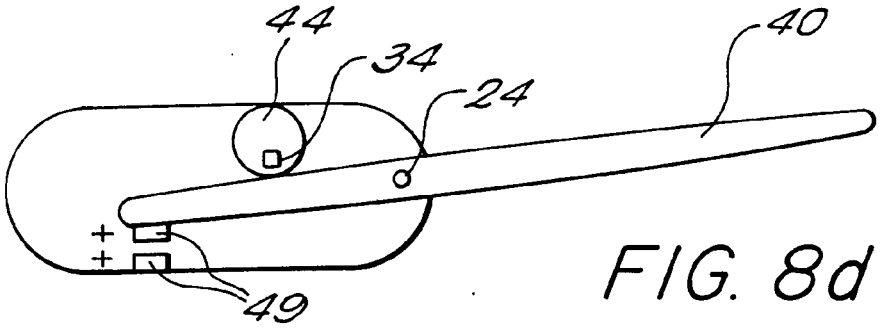
Figure 8E:
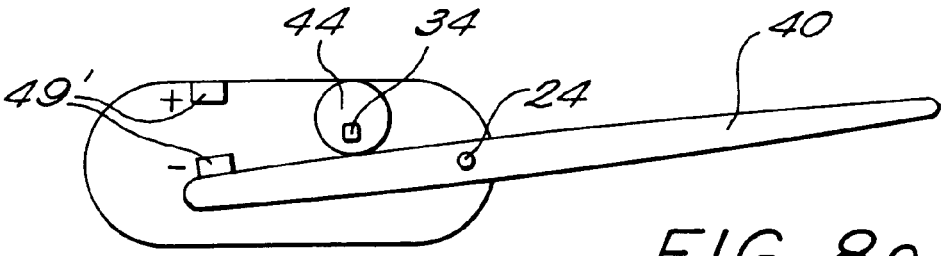
Figure 9:
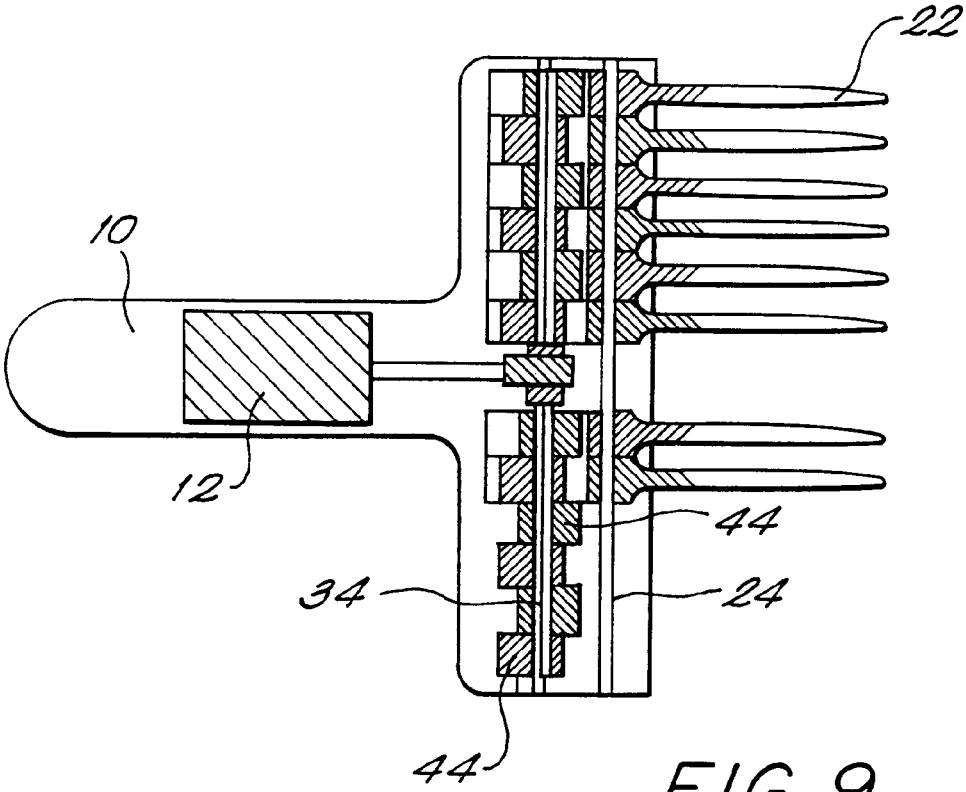

FIG. 3*a* shows a tooth of a comb, engaged with a cam of the camshaft;

FIG. 3*b* shows a tooth of a comb, with two non parallel prongs;

FIG. 3*c* shows a tooth of a comb with a cylindrical central portion;

FIG. 3*d* shows a cam confined in a circular aperture in a tooth;

FIG. 4 shows a diagram of a further embodiment in which the teeth are driven by a crankshaft;

FIG. 5*a* shows a tooth with an oblong aperture instead of a fork;

FIG. 5*b* shows a variation of the preceding embodiment, with the camshaft and fixed shaft interchanged;

FIG. 6 is a longitudinal cross section of a tooth with centering studs;

FIG. 7*a* is a cross section of an appliance with multiple teeth;

FIG. 7*b* is a longitudinal cross section of the preceding embodiment, showing two adjacent teeth connected by centering studs;

FIGS. 8*a* and 8*b* are two diagrams of two other embodiments, in which each tooth is guided by a camshaft and a spring;

FIG. 8*c* shows a further embodiment in which each tooth is guided by a camshaft and a leaf spring;

FIGS. 8*d* and 8*e* show two further embodiments in which each tooth is guided by a camshaft and a pair of magnets; and FIG. 9 shows a comb with its handle perpendicular to the camshaft.

DETAILED DESCRIPTION

Figure 1:
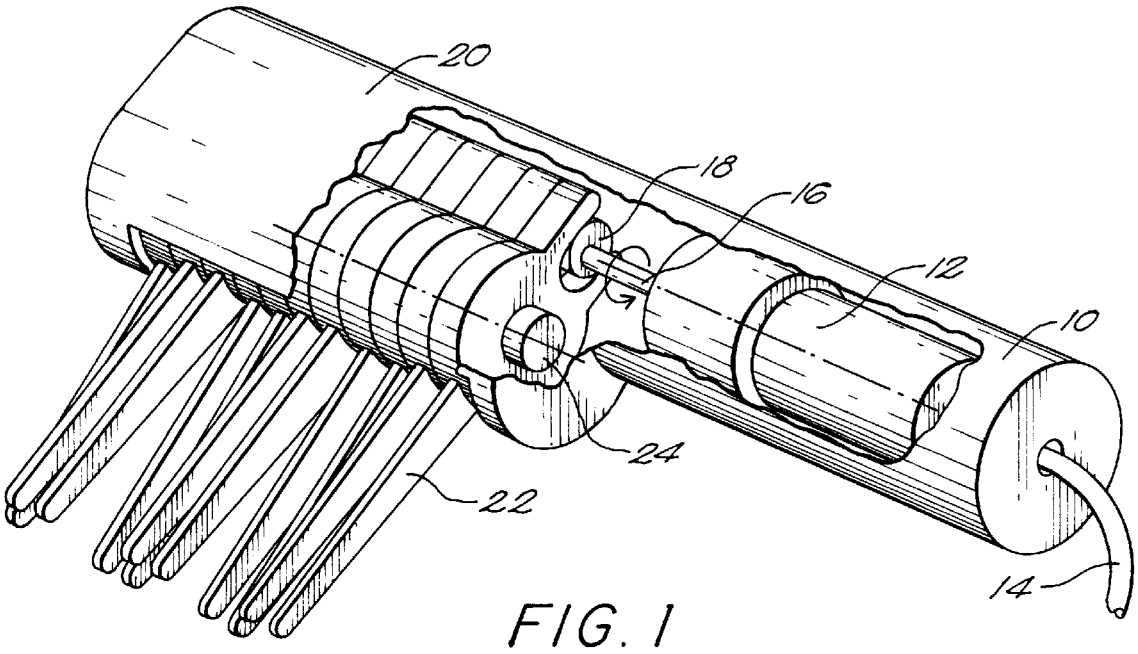
FIG. 1 is a diagram of an electric comb of the invention, with part of the handle cut away to show the internal elements.

A preferred embodiment of a comb of the invention is shown in FIG. 1 where a cutaway view allows the essential characteristics to be seen. The comb comprises a handle with a first portion 10 which is held in the user's hand containing a rotary electric motor 12 powered by the mains via a flex 14. Motor 12 turns a drive shaft 16 which acts as the shaft of a camshaft 18 located in a second portion 20 of the handle. In general, the camshaft 18 is made up of a run of cams in permanent contact with the ends of a set 22 of rigid teeth.

When shaft 16 of camshaft 18 is rotated by electric motor 12, the set of teeth 22 are caused to pivot or oscillate with respect to a fixed common shaft 24 in the second portion 20 of the handle. As will be seen, the motion of each tooth is different from that of the two teeth to which it is adjacent. When in use, the user keeps the set of teeth 22 in a horizontal position and activation of the motor causes the teeth to move, and because of their different motions, they comb out the hair. During combing out, the user can move the comb from top to bottom or back to front.

Figure 2:
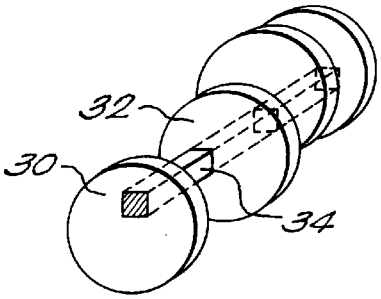
FIG. 2 shows a portion of a camshaft.

In a preferred embodiment of the invention, the camshaft is made up of circular cams as shown in FIG. 2. Each circular cam 30 or 32 is eccentrically fixed on a square section shaft 34. In the embodiment shown in FIG. 2, each cam is offset by an angle of 180° from the preceding cam, i.e., all of the even cams are fixed the same way, and all of the odd cams are fixed the same way on the camshaft, and each set of cams is offset by 180° from the other.

A tooth of the comb is engaged with its associated cam as shown in FIG. 3*a*. The tooth comprises a first portion 40 outside the handle which combs out the hair, and a second portion 42 in the form of a fork with two parallel prongs, the two integral portions 40 and 42 being articulated about fixed shaft 24. The two prongs 43, 45 of the portion 42 of the tooth surround cam 44 and remain in contact therewith.

In the position shown in FIG. 3*a*, the tooth is at its highest point because the distance between shaft 34 and the tangent point 46 of cam 44 with the lower prong 45 of fork 42 is at its greatest.

At the same time, with the disposition of the cams shown in FIG. 2 where two adjacent cams are offset by an angle of 180°, the two teeth adjacent the tooth shown in FIG. 3*a* are in the low position. As shaft 34 rotates in the direction of the arrow, the cam comes closer to the portion interconnecting the two prongs of the fork and is at a minimum distance (which may be in contact) when portion 40 is horizontal, i.e., at the mid point of its oscillatory motion. Shaft 34 continues to turn, and point 46 of the cam (the point furthest from shaft 34) is at its highest point and is the tangent point of the cam with the upper prong 43 of fork 42 when portion 40 is in its lowest position. It can thus be seen that as fixed shaft 34 is rotated, each tooth oscillates or pivots with respect to fixed shaft 24, the alternating motion or oscillations of two adjacent teeth being opposite (or inverse) if a camshaft such as that shown in FIG. 2 is used.

However, while still using circular cams which are eccentric to the drive shaft, the angular offsets between two adjacent cams can be adjusted to obtain a different tooth motion. Thus, in contrast to the embodiment shown in FIG. 2 where the oscillatory motions of two adjacent teeth are opposed, the cams fixed on the camshaft can be offset from the preceding cam by a smaller angle, for example 15° to 150°, preferably 90°. In this case, the oscillatory motion of each tooth is retarded relative to the oscillatory motion of the preceding tooth by an amount corresponding to this offset. Thus the general movement of the set of teeth is a wavelike movement corresponding to the reduced offset between pairs of adjacent teeth.

It has been shown that this motion, which is more gentle than the motion described above where the offset between the teeth is a maximum, is more comfortable and does not injure the hair. Further, this motion produces a very agreeable sensation, especially in an individual with a particularly sensitive scalp.

FIG. 3*b* shows a tooth with two non-parallel prongs 43' and 45' at its rear portion. In this case, cam 44 is not always in permanent contact with both prongs.

As can be seen in FIG. 3*c*, the skilled person can readily replace the fixed shaft 24 by walls 25 of arcuate shape which confine the central portion 47 of each tooth between them, allowing them to perform oscillatory motion.

In a second embodiment of the method of the invention, the desired effect can be obtained, namely combing out the hair. In this embodiment, the camshaft is replaced by a crankshaft 50 as shown in FIG. 4. Each tooth 52 is hinged on a crank 54 of the crankshaft. Because tooth 52 performs reverse motion (or vice versa) at the same time as it performs downwards motion (or vice versa) due to rotation of crank 54 of the crankshaft driving it, it includes an oblong hole 56 through which the fixed common shaft 24 passes, to give the shaft the required degree of freedom. Rotary motion is thus imparted to portion 58 of the tooth which is in the hair, which is represented diagrammatically by a circular arrow in FIG. 4. This motion is offset (by 180°) from that of the two adjacent teeth. Circular motion can be advantageous for certain types of hair for which simple vertical motion is not sufficient for combing out.

FIG. 5*a* shows a tooth with an aperture 62 in place of a fork with two prongs. Cam 44 is in permanent contact with the two parallel walls of aperture 62.

FIG. 5*b* shows a variation of the preceding embodiment, with camshaft 34 for cams 44 and fixed shaft 24 reversed. Here, cam 44 is at its lowest point and thus the point of the tooth is also at its lowest point.

FIG. 6 is a longitudinal cross section of a tooth with centering studs 60. Each stud 60 nests in the female portion 61 of the neighboring tooth (not shown).

FIG. 7*a* is a cross section of an appliance with multiple teeth or with different teeth. The appliance can have two series of teeth 40 and 40', one on each side of the drive mechanism 64.

FIG. 7*b* is a longitudinal cross section of the above with two adjacent teeth connected by centering studs. Here, the teeth of the first series 40, intended for combing out, are fewer and more spaced out than those of the opposite series 66, intended for styling.

FIGS. 8*a* and 8*b* are two diagrams of two further embodiments, in which the teeth are substantially straight and each tooth is guided by a camshaft 34, 44 and by a spring. Spring 48 can be on the same side as the camshaft, as shown in FIG. 8*a*, and in this case it connects the rear end of the tooth to the wall and keeps the tooth in permanent contact with cam 44 by tension. It can equally well be on the side opposite the camshaft, as shown in FIG. 8*b*. In this case, a spring 48' connects the rear end of the tooth to the wall opposite the camshaft and keeps the tooth in permanent contact with cam 44 by compression.

FIG. 8*c* shows a further embodiment in which the spring of the preceding embodiment is replaced by a leaf spring 48".

FIGS. 8*d* and 8*e* show two further embodiments in which each tooth is guided by a camshaft and a pair of magnets. In FIG. 8*d*, two magnets of the same polarity (in this case positive) keep tooth 40 in permanent contact with cam 44. In FIG. 8*e*, two magnets 49' of opposite polarity attract to keep tooth 40 in permanent contact with cam 44.

FIG. 9 shows a comb in which handle 10 containing electric motor 12 is perpendicular to camshaft 34. The rotary motion is transmitted from shaft 16 of the motor to camshaft 34 by means of a worm.

The comb of the invention may have teeth that are long or short, for example in the range 4 centimeters (cm) to 15 cm, and may have teeth of different lengths. The width of the tooth can, for example, be in the range 1.5 millimeters (mm) to 5 mm. Their distance apart may be greater or smaller depending on the thickness of the hair to be combed out, an example being 2 mm to 6 mm.

The teeth are preferably made of plastics material, but can be made of metal. They can be of any shape, with straight edges or with slightly shaped edges. The shaped form of the tooth shown in FIG. 5 is perfectly suited to giving volume to a style.

While a number of preferred embodiments have been described above, the skilled person is free to use any other drive means for the teeth in place of the camshaft or crankshaft without departing from the ambit of the invention.

What is claimed is:

1. An electric comb for combing out and styling, comprising:

an electric motor;

a handle designed to be held by a user;

a body secured to said handle;

a tooth drive mechanism including a series of teeth and a crankshaft, said crankshaft rotatable by said motor and including eccentric crank elements, each eccentric crank element suitable for cooperating with a tooth such that the tooth pivots about an axis; and each tooth including a first portion outside said body, and a second portion inside said body, said second portion including a guide for guiding the tooth by said crank elements.

2. The electric comb of claim 1, wherein said second portion of each tooth includes two straight prongs, an eccentric element being received between said prongs.

3. The electric comb of claim 1, wherein said second portion of each tooth includes an oblong aperture, an eccentric element being received in said oblong aperture.

4. The electric comb of claim 1, wherein said second portion of each tooth includes a circular aperture an eccentric element being received in said circular aperture.

5. The electric comb of claim 1, wherein said tooth drive mechanism includes a second fixed shaft extending through each tooth, about which each tooth is pivotable.

6. The electric comb of claim 5, wherein the portion of each tooth through which the fixed shaft passes is a circular aperture.

7. The electric comb of claim 5, wherein the portion of each tooth through which the fixed shaft passes is an oblong aperture.

8. The electric comb of claim 1, wherein each tooth includes a centering stud nested in a female portion of an adjacent tooth.

9. The electric comb of claim 1, wherein the second portion includes a portion which is substantially in the form of an arc of a circle, which is confined in a substantially cylindrical portion of the body, about which the tooth is pivotable.

10. The electric comb of claim 5, wherein the axis of rotation or pivoting of the teeth extends between the drive mechanism and the outer portion of each tooth.

11. The electric comb of claim 5, wherein the drive mechanism extends between the axis of rotation or pivoting of the teeth and the outer portion of each tooth.

12. The electric comb of claim 1, wherein the eccentric elements are not angularly offset with respect to each other and turn in phase during their rotation.

13. The electric comb of claim 1, wherein each eccentric element on said rotary mechanism is angularly offset by a predetermined amount with respect to a preceding element.

14. The electric comb of claim 13, wherein the angular offset is 90 degrees.

15. The electric comb according to any one of the preceding claims wherein the comb is provided with teeth on two sides of the drive mechanism.

16. The electric comb of claim 15, wherein certain teeth are provided with multiple tips.

17. The electric comb of 16, wherein the comb is provided with an air blower.

18. The electric comb of claim 17, wherein the motor shaft is perpendicular to the camshaft and the fixed shaft.

19. The electric comb of claim 18, wherein the set of teeth is removable.

20. The electric comb of claim 19, wherein the motor is external to the appliance and the rotary motion is transmitted by a transmission cable.

21. An electric comb for combing out and styling, comprising:

an electric motor;

a handle designed to be held by a user;

a body secured to said handle;

a tooth drive mechanism including a series of teeth and a camshaft, said camshaft including cams fixed eccentrically to said camshaft, said camshaft rotatable by said motor, each cam suitable for cooperating with a tooth such that the tooth pivots about an axis; and each tooth comprising a first portion outside said body, and a second portion inside said body, said second portion including an oblong aperture which guides one of said cams.

22. The electric comb of claim 21, wherein each cam of the camshaft has a substantially circular cross section.

23. The electric comb of claim 21, wherein each cam of the camshaft has substantially elliptical cross section.

24. The electric comb of claim 21, wherein said tooth drive mechanism includes a second fixed shaft extending through each tooth, about which each tooth is pivotable.

25. The electric comb of claim 21, wherein each tooth includes a centering stud nested in a female portion of an adjacent tooth.

26. The electric comb of claim 21, wherein the second portion includes a portion which is substantially in the form of an arc of a circle, which is confined in a substantially cylindrical portion of the body, about which the tooth is pivotable.

27. The electric comb of claim 21, wherein each eccentric element is angularly offset by a predetermined amount with respect to a preceding element.

28. An electric comb for combing out and styling, comprising:

an electric motor;

a handle designed to be held by a user;

a body secured to said handle;

a tooth drive mechanism including a series of teeth, a camshaft, and eccentric elements, said camshaft rotatable by said motor, each eccentric element suitable for cooperating with a tooth such that the tooth pivots about an axis, said eccentric elements comprising cams fixed eccentrically to said camshaft; and each tooth comprising a first portion outside said body, and a second portion inside said body, said second portion including two straight prongs, a cam being received between said prongs.

29. The electric comb of claim 28, wherein said tooth drive mechanism includes a second fixed shaft extending through each tooth, about which each tooth is pivotable.

30. The electric comb of claim 28, wherein each tooth includes a centering stud nested in a female portion of an adjacent tooth.

31. The electric comb of claim 28, wherein each tooth includes a portion which is substantially in the form of an arc of a circle, which is confined in a substantially cylindrical portion of the body, about which the tooth is pivotable.

32. The electric comb of claim 28, wherein each eccentric element on said camshaft is angularly offset by a predetermined amount with respect to a preceding element.

33. The electric comb for combing out and styling, comprising:

an electric motor;

a handle designed to be held by a user;

a body secured to said handle;

a series of teeth, each tooth comprising a first portion outside said body, and a second portion inside said body;

a tooth drive mechanism including eccentric elements, each eccentric element suitable for cooperating with a tooth such that the tooth pivots about an axis;

said tooth drive mechanism including a camshaft, said camshaft including cams fixed eccentrically to said camshaft, said camshaft rotatable by said motor, said cams acting on said teeth and cooperating with return means.

34. The electric comb of claim 33, wherein said return means are magnets.

35. The electric comb of claim 33, wherein said return means are leaf springs.

36. The electric comb of claim 33, wherein said return means are springs.

* * * * *